United States Patent [19]

Bertsch et al.

[11] Patent Number: 4,984,608

[45] Date of Patent: Jan. 15, 1991

[54] TUCK-IN NEEDLE AND A PNEUMATIC SELVEDGE-FORMING DEVICE FOR A LOOM

[75] Inventors: Gotthilf Bertsch, Ruti; Josef Braum, Seuzach, both of Switzerland

[73] Assignee: Sulzer Brothers Limited, Winterthur, Switzerland

[21] Appl. No.: 379,920

[22] Filed: Jul. 14, 1989

[30] Foreign Application Priority Data

Jul. 14, 1988 [CH] Switzerland ..... 02706/88

[51] Int. Cl.[5] ..... D03D 47/48

[52] U.S. Cl. ..... 139/434

[58] Field of Search ..... 223/102, 103, 104; 139/434, 439, 194; 128/339; 112/222, 223, 224, 80.08, 80.15, 80.16; 28/110, 115

[56] References Cited

U.S. PATENT DOCUMENTS 4,194,457 3/1980 Parsons ..... 112/222
4,552,187 11/1985 Bertsch et al. ..... 139/434

FOREIGN PATENT DOCUMENTS 0134377 3/1985 European Pat. Off. .
0149969 7/1985 European Pat. Off. .
0306080 3/1989 European Pat. Off. ..... 139/434
488939 7/1925 Fed. Rep. of Germany ..... 112/222
0725262 9/1942 Fed. Rep. of Germany .
2036401 4/1971 Fed. Rep. of Germany .
2141808 1/1973 France .

*Primary Examiner*—Andrew M. Falik
*Attorney, Agent, or Firm*—Kenyon & Kenyon

[57] ABSTRACT

A selvedge-forming device has a tuck-in needle having, at least in the end part introducible into the shed, a wedge shaped cross-section. The needle also has an elongate yarn entry aperture whose major dimension extends in the direction of the length of the end part of the needle. The end part also has an end face which leads in the direction of entry into the shed and which co-operates with the long side near the reed to form a tip pointing away from the shed apex. The needle can make pivoting movements out of the shed very close to the shed apex so that the weft yarn end is tucked in correspondingly close to the shed apex. Because of the elongate shape of the aperture the weft yarn end can be bent readily and can therefore be threaded into the aperture with a reduced blowing pressure of a threading nozzle.

18 Claims, 2 Drawing Sheets

Fig.1
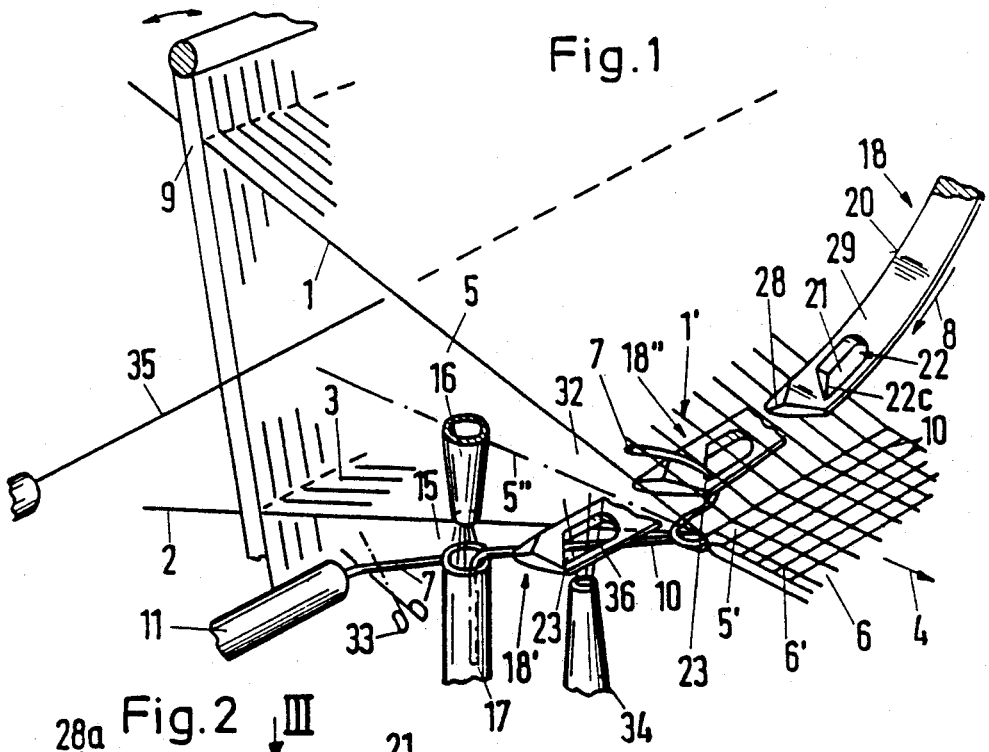
Fig.2
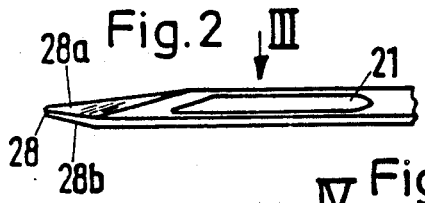
Fig.3
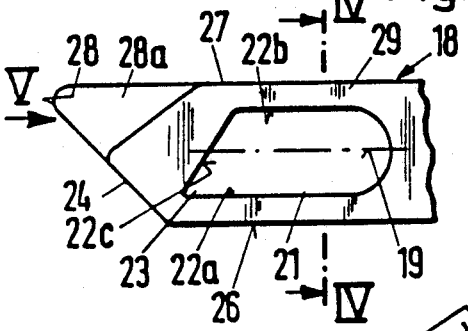
Fig.4
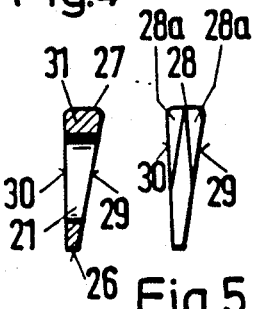
Fig.5
Fig.6
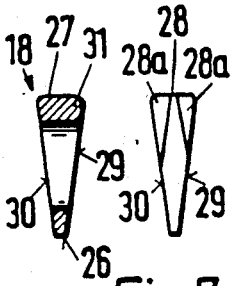
Fig.7
Fig.8
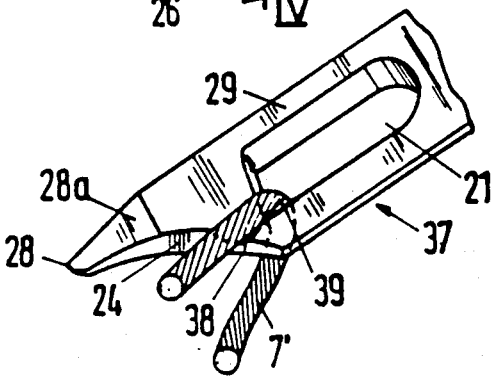

TUCK-IN NEEDLE AND A PNEUMATIC SELVEDGE-FORMING DEVICE FOR A LOOM

The invention relates to a tuck-in needle and a pneumatic selvedge-forming device for a loom.

Heretofore, various types of devices have been known for forming a selvedge in a cloth being woven on a loom. For example, German Pat. No. 725,262 describes a pneumatic device for blowing the end of a weft yarn into a shed of warp yarns in order to form a selvedge. German O.S. No. 2,036,401 and French Pat. No. 2,141,808 describe selvedge-forming devices employing a curved hollow tube which can be inserted into a shed in order to pull the end of a severed weft yarn into a shed to form a selvedge European Pat. Nos. 0,134,377 and 0,149,969 describe selvedge-forming devices which employ a tuck-in needle adapted to tuck in the end of a weft yarn from outside of a shed. In this respect, the tuck-in needle is of strip-like rectangular cross section with a circular eye for receiving the end of the weft yarn. However, since the needle is relatively narrow, the circular eye cannot be of large diameter. Consequently, the length of the weft yarn end portion spanned by the eye before threading is reduced. Furthermore, the weft yarn end can only be bent and threaded if the blowing pressure of a threading nozzle is high. Air consumption is therefore relatively substantial.

Furthermore, the known needle has a point formed in the middle of the width of the wide sides of the end part comprising the eye. In order to facilitate an inwards movement of the end part into a shed, a determined minimum distance between the point of the needle and the shed apex is necessary. In the known device, the needle cannot be moved close to the shed apex, and so the distance between the tucked-in weft yarn end and the shed apex is relatively large.

A selvedge-forming device known from German O.S. No. 2,030,401 and corresponding Swiss Pat. No. 514 705 comprises a circular section suction type tuck-in needle. This needle has a suction inlet which is formed by a bevelling of the needle end and which is correspondingly enlarged. Unfortunately, in this device, as in the device previously referred to, there is a relatively large minimum distance between the needle and the shed apex, something which is disadvantageous for the formation of a uniform selvedge.

Accordingly, it is an object of the invention to provide a tuck-in needle which can be moved into a shed of warp yarns close to the apex of the shed.

It is another object of the invention to provide a tuck-in needle with an enlarged aperture so as to span a substantial length of a weft yarn to be inserted therein.

It is another object of the invention to be able to obtain a uniform selvedge in a woven cloth.

It is another object of the invention to provide a pneumatic selvedge forming device capable of forming a uniform selvedge.

Briefly, the invention provides a tuck-in needle for a pneumatic selvedge-forming device for a loom wherein the needle has a curved end part having an angled end face defining a tip with a narrow longitudinal side face thereof to facilitate passage between two adjacent warp yarns. In addition, the end part includes a narrow side face opposite the longitudinal side face and an elongated longitudinally extending yarn entry aperture between the side surfaces.

The construction of the tuck-in needle is such that the tip formed on the end face is on a side remote from a shed apex. Thus, the distance between the tip of the needle and the shed apex is such as to permit the needle to be moved close to the shed apex. The aperture of the needle may also have a pair of edge parts defining an acute-angled corner to receive a weft yarn on a side proximate to the shed apex. Thus, the end of the weft yarn can be positioned closer to the shed apex. The overall construction of the needle ensures accurate engagement and uniform tucking-in of the tucked-in weft yarn and, therefore, the formation of a uniform selvedge of constant weft.

These and other objects and advantages of the invention will become more apparent from the following detailed description taken in conjunction with the accompanying drawings wherein:

FIG. 1 illustrates a perspective view of a part of a selvedge-forming device according to the invention, the device comprising a tuck-in needle which is shown only partly and in three operative positions;

FIG. 2 illustrates a view to an enlarged scale and in side elevation of a part of the needle of FIG. 1;

FIG. 3 illustrates a plan view of the needle looking in the direction of arrow III of FIG. 2;

FIG. 4 illustrates a view taken on line IV—IV of FIG. 3;

FIG. 5 illustrates a view taken in the direction of arrow V of FIG. 3;

FIG. 6 illustrates a cross-sectional view of another embodiment of a tuck-in needle in accordance with the invention;

FIG. 7 illustrates an end view of the needle of FIG. 6;

FIG. 8 illustrates a perspective and partial view of a variant tuck-in needle in accordance with the invention;

Figure 9:
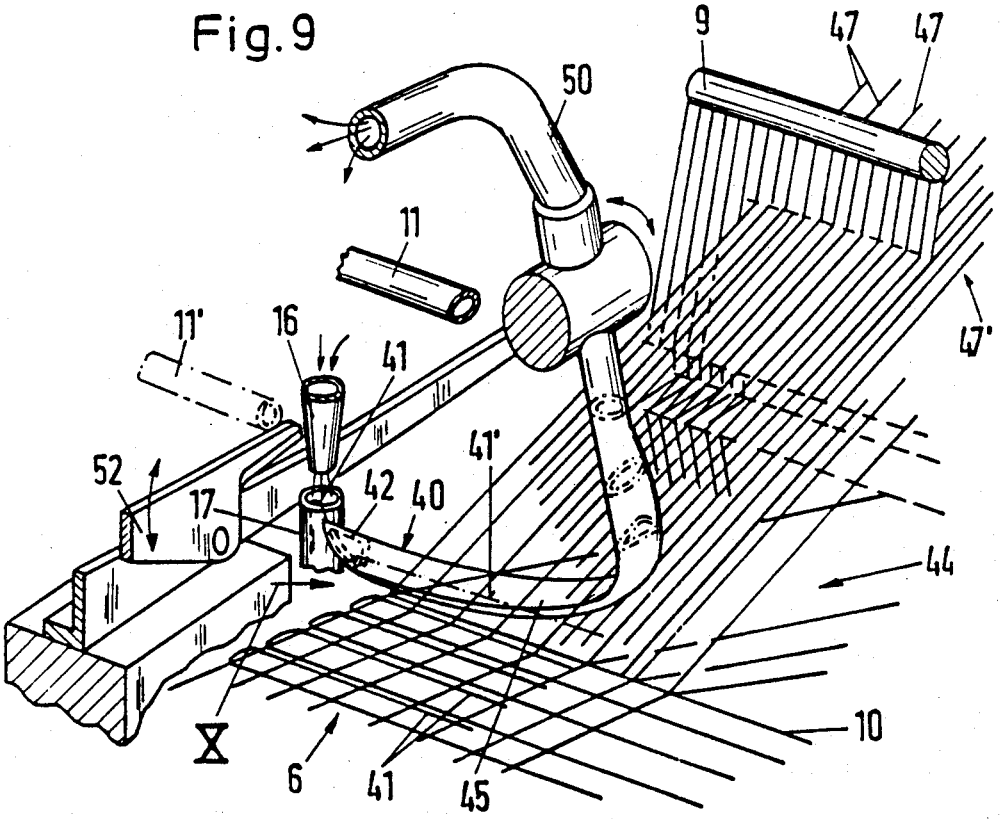
FIG. 9 illustrates part of another embodiment of a selvedge-forming device comprising a suction type tuck-in needle in accordance with the invention.

Referring to FIG. 1, upper-shed warp yarns 1 and lower-shed warp yarns 2 of the edge zone 3 of the warp on the picking side of an air jet loom are illustrated when the shed 5 is open. A cloth 6 produced from the warp yarns 1, 2 and weft yarns 10 is guided from a shed apex 5', in the direction indicated by an arrow 4, by way of a breast beam (not shown), towards the cloth beam of the loom. A weft yarn end 7 projecting from the shed 5 of the weft yarn 10 most recently picked up by a picking nozzle 11 and beaten up by a reed 9 into the shed apex 5' is kept stretched by the picking nozzle 11 on the picking side and, on the catching side (not shown), by a stretching nozzle which is disposed opposite the picking nozzle 11. Each of these weft yarn ends 7 passes through retaining means 15 comprising a blowing nozzle 16 and a catching nozzle 17.

Associated with each of the edge zones 3 is a selvedge-forming device whose construction and operation have been described in greater detail, for example, in the previously-mentioned European Pat. No. 0 149 969. As FIG. 1 shows, each such device comprises a tuck-in needle 18 of which only an end part 20 is shown and which is movable into the shed 5. In known manner, per loom main shaft revolution, the needle 18 performs a pivoting-in movement, indicated by an arrow 8, through the upper shed warp yarns 1 into the shed 5 and, having engaged the weft yarn end 5, a corresponding pivoting-out movement from the shed 5. The needle 18 is strip-like at least in the end part 20 and is formed at the free end with a yarn entry aperture in the form of an eye or aperture 21.

Referring to FIG. 3, the eye 21 has an elongate shape 22 whose major axis 19 coincides with the longitudinal axis of the needle part 20. The relatively long edge parts **22*a*, 22*b* of the eye 21 extend parallel to the major axis 19. The shorter edge part 22*c* of the eye 21, such part leading in the pivoting-in direction of the needle 18, is directed inclinedly forwards towards the shed apex 5' in the entry direction (arrow 8 in FIG. 1) and co-operates with the edge apex 22*a* proximate the cloth to form an acute-angled corner 23**.

A leading end face 24 of the needle 18 is angled so that a tip 28 is formed on that longitudinal side 27 of the needle 18 which is remote from the shed apex 5' and which is on the reed side. The apex or tip 28 is further pointed by at least one or, as shown in FIG. 2, two bevellings **28*a*, 28*b* extending one each over wide sides 29, 30 of the needle 18**.

As known from European Pat. No. 0 149 969, the needle 18, or at least the end part 20, can have a thin rectangularly shaped cross-section determined by parallel wide sides 29, 30 and narrow long sides 26, 27. In the embodiment shown in FIGS. 1 to 5, the needle 18 so narrows in the end part 20 towards the shed apex 5' that the top wide side 29 extends, in the position in which the end part 20 has been pivoted into the shed 5, substantially parallel to the warp yarns 1 of the upper shed, while the bottom wide side 30 extends substantially parallel to shed center-plane 5''. Consequently, as a comparison of FIGS. 1 and 4 will show, the wedge shape of the cross-section 31 of the needle 18 coincides with the shape of the top subcross-section 32 of the partly opened shed 5, the subcross-section 32 being bounded in the top half 1' of the shed by the upper-shed warp yarns 1 and the shed center-plane 5''.

According to another feature, a corresponding cross-section of the needle 18 can be adapted to the shape of the shed bottom cross-section bounded by the lower shed warp yarns 2 and the shed center-plant 5''.

Referring to FIGS. 6 and 7, the cross-section 31 of the needle 18 can be adapted to the shape of the complete cross-section of the partly opened shed 5 as bounded by the upper-shed warp yarns 1 and the lower-shed warp yarns 2. In this embodiment, each of the two wide sides 29, 30 of the needle 18 extends substantially over half the thickness of the cross-section 31 conically from the long side 27 near the reed to the long side 26 of the part 20 near the cloth.

Referring to FIG. 1, during operation, immediately before the weft yarn end 7 is tucked in, shears 33 sever the weft yarn 10 shortly after the blowing nozzle 16 has been actuated to blow the weft yarn end 7 into the stretching nozzle 17 which keeps such end stretched. Meanwhile, the needle 18 has moved out of the shed 5 near the end of the pivoting-in movement and has stopped in a weft yarn receiving position 18' in which the eye 21 is disposed above a threading nozzle 34. The blowing nozzle 16 and the catching nozzle 17 are then cut out of operation and the threading nozzle 34 is brought into operation. The threading nozzle 34 which blows into the eye 21 pulls the weft yarn end 7 out of the catching nozzle 17 and threads the yarn end 7 into the eye 21. Thereafter, the threading nozzle 34 is cut out of operation. Simultaneously, the needle 18 starts a pivoting-out movement through position 18'' from the shed 5, the engaged weft yarn end 7 being drawn into the shed 5.

During the pivoting-out movement of the needle 18, the shed changes so that the tucked-in weft yarn end 7 is, in known manner, engaged around by the warp yarns of the new shed and tucked in. When the next weft yarn 35 is beaten up by the reed 9 at the shed apex 5', the weft yarn end 7 is beaten up simultaneously with the weft yarn 35 and then forms a part of the selvedge 6'.

The advantages of the construction and shape hereinbefore described of the needle 18 and eye 21 will be clearly apparent from the description hereinbefore given of the tucking-in of the weft yarn end 7. The needle 18, by virtue of the substantially triangular or, as illustrated, trapezoidal cross-section 31 which narrows over the end part 20 towards the shed apex 5', or, in another embodiment, with an end part having a rectangularly shaped cross-section of a correspondingly small thickness, can perform pivoting movements very near the shed apex 5'. Thus, the weft yarn end 7 entrained in the pivoting-out movement can be tucked in very near the shed apex 5'. The effect is enhanced by the inclined shape of the leading edge part **22*c* of the eye 21 which centers the weft yarn end 7 since the threaded weft yarn end 7 slides on the part 22*c* towards the shed apex 5' and moves very close thereto. During the rapid outwards movement of the needle 18, the weft yarn end 7 stays guided in the corner 23 formed by the edge parts 22*a*, 22*c* of the aperture 22**.

Instead of the straight edge part **22*c* shown, a corresponding front edge part which has a concave or convex curvature relatively to the eye 21 can be provided, such edge part cooperating with the edge part 22*a* on the cloth side to form a corner 23 centering the weft yarn end 7**.

Because of the elongate form of the eye 21, the length of the weft yarn portion 36 which before threading spans the eye 21 at least substantially parallel to the major axis 19 thereof is relatively large. Thus, bending of the yarn portion 36 is facilitated and threading therefore requires only a reduced blowing pressure of the threading nozzle 34.

The pointed tip 28 of the needle 18 formed on the long side 27 near the reed facilitates division of the upper shed warp yarns 1 in the inwards pivoting movement into the shed 5 since the warp yarns 1, 2 are more resilient in this zone than at the shed apex 5' and are therefore stressed correspondingly less.

Referring to FIG. 8, wherein like reference characters indicate like parts as above, the retaining effect of an acute-angled corner 39 formed in the eye 21 of a needle 37 can be further enhanced by a groove 38 which is of trough-shaped cross-section, is present in the top wide side 29 of the needle 37, extends from the corner 39 as far as the needle end face 24 and provides non-slip guidance of the weft yarn end 7'. More particularly, in the case of relatively stiff yarns, this feature can be used to oppose a tendency inherent in such yarns to stretch.

As can also be gathered from FIG. 8, the end face 24 of the needle 37, like the end face of the needle 18, can be concave. A corresponding convex construction of the end face 24 is of course also possible. Also, in a variant, the bottom wide side 30 can be formed with a corresponding groove instead of or in addition to the groove 38 in the top wide side 29.

Referring to FIG. 9, the selvedge forming device may use a hollow suction-type tuck-in needle 40 which, at an inlet 42 effective as a yarn entry aperture, engages the weft yarn end 41 to be tucked in by suction. The needle 40 has, at least in an end part 45 pivotable into the shed 44, a substantially triangular cross-section 43 whose shape is, as shown, adapted to the shape of the top sub-cross-section 46 of at least a partly opened shed 44, the sub-cross-section 46 being bounded by the upper-shed warp yarns 47 and center plane 44" of shed 44. In this construction, the cross-section 43 of the needle 40 can be adapted to the shape of the bottom sub-cross-section or of the complete cross-section of the shed 44. Also, at least the end part 45 of the needle 40 can have an elongate hollow cross-section determined by parallel wide sides 29, 30 and narrow long sides 26, 27.

Figure 10:
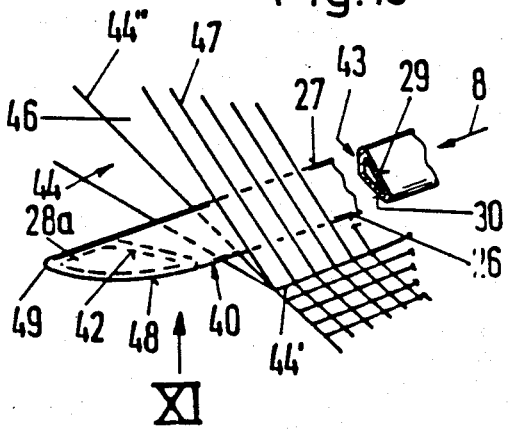
FIG. 10 illustrates a view of the suction type needle in the direction of arrow X of FIG. 9.
Figure 11:
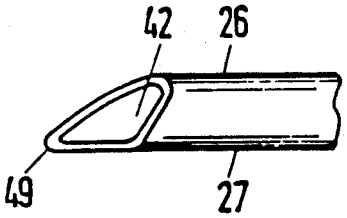
FIG. 11 illustrates a view of the suction type needle in the direction of arrow XI of FIG. 10.

Referring to FIGS. 10 and 11, that end face of the needle 40 which leads in the pivoting-in direction indicated by an arrow 8 extends at an inclination such that an apex 49 is formed on that long side 27 of the needle 40 which is remote from the shed apex 44' and which is on the reed side. By way of a flexible tube 50 or a corresponding rotary vacuum connection, the needle 40 is intermittently connected to a source (not shown) of negative pressure. When the needle 40 is in the position which is shown in FIG. 9 and which is reached at the end of the inwards pivoting movement, the inlet 42 is disposed above the weft yarn end 41 which has already been severed by shears 52, is retained by the catching nozzle 17 and spans the inlet 42 substantially parallel to the length of the longitudinal part 45—i.e., to the pivoting direction of the needle 40. By rendering the blowing nozzle 16 and catching nozzle 17 inoperative with a simultaneous production of negative pressure in the needle 40, the weft yarn end 41 is engaged by suction at the inlet 42 and sucked in. Thereafter, the needle 40 starts a pivoting-out movement and draws the engaged weft yarn end 41 into the shed 44 as indicated by a chain-dotted line 41'. The advantages hereinbefore mentioned in connection with the embodiment shown in FIGS. 1–7 are fully effective for the embodiment of the suction type needle 40.

The tuck-in needle is not limited to use in air jet looms and can be used in other kinds of loom such as gripper looms or projectile looms.

The invention thus provides a pneumatic selvedge-forming device which is able to tuck in a weft yarn end close to the beat-up position of the weft yarn so as to form a more uniform selvedge.

The invention also provides a tuck-in needle which is able to position a weft yarn end in a tuck-in position relatively close to a shed apex.

What is claimed is:

1. A tuck-in needle for a pneumatic selvedge-forming device for a loom, said needle having a strip-like end part movable into a shed of warp yarns, said end part having a cross-section with two wide sides, a first narrow side surface facing in a direction of an apex of said shed and a second narrow side surface facing in an opposite direction, said end part including an angled end face defining a tip directed in a direction away from said shed apex and an elongated yarn entry aperture extending longitudinally of said end part to receive a weft yarn end therein.

2. A needle as set forth in claim 1 wherein said aperture has a first edge part on a side proximate to the shed apex and parallel to the direction of movement of said needle end part into the shed, and a transversely disposed edge part defining an acute-angled corner with said first edge part.

3. A needle as set forth in claim 2 wherein said end part is beveled at an end thereof to facilitate entry between two adjacent warp yarns into the shed.

4. A needle as set forth in claim 1 wherein said end part includes a groove in one surface thereof extending from said yarn entry aperture toward a leading face of said end part to receive a weft yarn therein.

5. A needle as set forth in claim 1 wherein said cross-section is of wedge shape, the wide sides thereof converging from said second side surface towards said first side surface.

6. A needle as set forth in claim 1 wherein said end part is hollow and is connectable to a negative pressure source, and wherein said aperture defines a suction inlet to said hollow end part.

7. A tuck-in needle for a selvedge-forming device for a loom, said needle comprising a curved end part having an angled end face defining a tip with a narrow longitudinal side face thereof to facilitate passage between two adjacent warp yarns, said end part including a narrow side face opposite said longitudinal side face and an elongated longitudinally extending yarn entry aperture between said side faces.

8. A tuck-in needle as set forth in claim 7 wherein said end part is of solid construction and said aperture extends transversely through said end part.

9. A tuck-in needle as set forth in claim 7 wherein said aperture has a pair of edge parts defining an acute-angled corner to receive a weft yarn therein.

10. A tuck-in needle as set forth in claim 7 which further comprises a groove in a surface of said end part extending from said aperture to receive a weft yarn therein.

11. A tuck-in needle as set forth in claim 7 wherein said end part is hollow and said aperture defines a suction outlet to said hollow end part.

12. A pneumatic selvedge forming device for a loom comprising a tuck-in needle for movement through a shed of warp yarns into a weft receiving position, said needle having a curved end part with an angled end face defining a tip with a narrow side face thereof to facilitate passage between two warp yarns of the shed of warp yarns, said end part including a narrow side face opposite said narrow side face and an elongated longitudinally extending yarn entry aperture between said slide faces; and a catching nozzle to receive a severed end of a weft yarn for positioning opposite said aperture of said needle with said needle in said weft receiving position.

13. A device as set forth in claim 12 which further comprises a nozzle for blowing a weft yarn end through said aperture of said needle with said needle in said weft receiving position.

14. A device as set forth in claim 12 wherein said end part is hollow and which further comprises means for drawing air through said hollow end part and said aperture to draw a weft yarn end into said end part.

15. A tuck-in needle for a pneumatic selvedge-forming device for a loom, said needle having a strip-like curved end part movable into a shed of warp yarns approximately parallel to and at a clearance from an apex of said shed, said end part having a thin cross-section with a first narrow side surface facing in a direction of said apex of said shed and a second narrow side surface facing in an opposite direction, said end part including an angled end face defining a tip directed in a direction away from said shed apex and an elongated yarn entry aperture extending longitudinally of said end part to receive a weft yarn end therein.

16. A needle as set forth in claim 15 wherein said end part is beveled at an end thereof to facilitate entry between two adjacent warp yarns into the shed.

17. A needle as set forth in claim 15 wherein said end part includes a groove in one surface thereof extending from said yarn entry aperture toward a leading face of said end part to receive a weft yarn therein.

18. A needle as set forth in claim 15 wherein said end part is hollow and is connectable to a negative pressure source, and wherein said aperture defines a suction inlet to said hollow end part.

* * * * *

UNITED STATES PATENT AND TRADEMARK OFFICE

CERTIFICATE OF CORRECTION

PATENT NO. : 4,984,608

DATED : January 15, 1991

INVENTOR(S) : GOTTHILF BERTSCH, et al

It is certified that error appears in the above-identified patent and that said Letters Patent is hereby corrected as shown below:

Column 6, line 49 change "slide" to -side-.

Signed and Sealed this

Twenty-second Day of September, 1992

*Attest:*

DOUGLAS B. COMER

*Attesting Officer*

*Acting Commissioner of Patents and Trademarks*